US009869526B1

(12) United States Patent
Cheng et al.

(10) Patent No.: US 9,869,526 B1
(45) Date of Patent: Jan. 16, 2018

(54) FLIP-UP AIMING SIGHT

(71) Applicants: Carson Cheng, City of Industry, CA (US); Jason Michael Cheng, City of Industry, CA (US); Changan Tian, City of Industry, CA (US)

(72) Inventors: Carson Cheng, City of Industry, CA (US); Jason Michael Cheng, City of Industry, CA (US); Changan Tian, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 15/358,095

(22) Filed: Nov. 21, 2016

(51) Int. Cl.
*F41G 1/34* (2006.01)
*F41G 1/10* (2006.01)
*F41G 1/17* (2006.01)

(52) U.S. Cl.
CPC ..... *F41G 1/345* (2013.01); *F41G 1/10* (2013.01); *F41G 1/17* (2013.01)

(58) Field of Classification Search
CPC ... F41G 1/34; F41G 1/345; F41G 1/35; F41G 1/36; F41G 1/10; F41G 1/17; G02B 23/105
USPC ..... 42/113, 114, 115, 117, 131, 132
See application file for complete search history.

(56) References Cited

U.S. PATENT DOCUMENTS 2,276,446 A * 3/1942 Zimmermann ..... F41G 1/033 42/140
5,369,888 A * 12/1994 Kay ..... F41G 1/30 356/252
5,577,326 A * 11/1996 Montelin ..... F41G 1/16 356/251
7,921,591 B1 * 4/2011 Adcock ..... F41G 1/14 42/111
9,696,114 B1 * 7/2017 Cabrera ..... F41G 1/17
2002/0078618 A1 * 6/2002 Gaber ..... F41G 1/345 42/123
2010/0064535 A1 * 3/2010 Kingsbury ..... F41G 1/30 33/265
2014/0150325 A1 * 6/2014 Keng ..... F41G 11/003 42/118
2015/0198415 A1 * 7/2015 Campean ..... F41G 1/18 42/137
2015/0267997 A1 * 9/2015 Collin ..... G03H 1/0005 359/1
2016/0216068 A1 * 7/2016 Hancosky ..... F41G 1/345

* cited by examiner

*Primary Examiner* — Bret Hayes
(74) *Attorney, Agent, or Firm* — Raymond Y. Chan; David and Raymond Patent Firm

(57) ABSTRACT

A flip-up aiming sight for a firearm includes a mounting base having a top platform, an illuminator embedded under the platform of the mounting base, and a flip up lens module which includes a lens frame pivotally coupled at a front side of the mounting base and a reflecting lens encirclingly mounted at the lens frame. The flip up lens module is arranged to pivotally fold between a folded position and an unfolded position. At the folded position, the lens frame is rearwardly and downwardly folded flat on the platform of the mounting base, and at the unfolded position, the lens frame is frontwardly and upwardly moved from the platform, such that the illuminator generates an aiming point on the reflecting lens.

9 Claims, 6 Drawing Sheets

FLIP-UP AIMING SIGHT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a firearm accessory, and more particular to a flip-up aiming sight for a firearm, especially for handgun, wherein the reflecting lens can be folded flat on a platform to provide a low-profile aiming sight for the firearm and can be unfolded from the platform to automatically activate the illuminator to generate an aiming point on the reflecting lens.

Description of Related Arts

Conventional firearm, especially for a handgun or a pistol, usually needs different firearm accessories for assisting the operator to accurately locate the target and perform the shooting. Sighting device, such as a scope, reflex sight, telescope, camera lens module, or binoculars, generally comprises a tubular lens housing and a lens supported in the lens housing. For example, scopes are sighting devices and are commonly used in conjunction firearms to give an accurate aiming point and to aid the operator in properly aligning a barrel of the firearm with a desired target. However, these sighting devices are too big that the handgun or pistol cannot be fittingly received in a holster when the sighting device is mounted on the handgun or pistol.

In addition, the sighting device must be mounted on the firearm to parallel to the barrel axis of the firearm. In other words, when the sighting device is mounted on top of the firearm, the aiming point of the sighting device is orientated away from the barrel axis of the firearm. It is worth mentioning that the sighting device must be located close to the barrel axis of the firearm in order to precisely align the sighting device with the barrel axis of the firearm.

SUMMARY OF THE PRESENT INVENTION

The invention is advantageous in that it provides a flip-up aiming sight for a firearm, the reflecting lens can be folded flat on a platform of the mounting base to provide a low-profile aiming sight for the firearm and can be unfolded from the platform to automatically activate the illuminator to generate an aiming point on the reflecting lens.

Another advantage of the invention is to provide a flip-up aiming sight, wherein the illuminator is embedded at the mounting base to enable the reflecting lens to be folded flat on the platform.

Another advantage of the invention is to provide a flip-up aiming sight, wherein the illuminator is automatically switched on when the reflecting lens is moved at its unfolded position and is automatically switched off when the reflecting lens is moved at its folded position.

Another advantage of the invention is to provide a flip-up aiming sight, wherein the battery is received in the battery compartment at the bottom side of the mounting base, such that when the bottom side of the mounting base is coupled on the firearm, the battery is secured in the battery compartment to prevent any dislocation of the battery.

Another advantage of the invention is to provide a flip-up aiming sight, wherein the reflecting lens is locked at its folded position by a locking latch and a locking actuator. In particular, the locking actuator provides multiple functions of securely engaging with the locking latch to lock up the reflecting lens and actuating to disengage with the locking latch so as to enable the reflecting lens to move at its unfolded position.

Another advantage of the invention is to provide a flip-up aiming sight, wherein the reflecting lens is automatically moved from its folded position to its unfolded position once the reflecting lens is unlocked.

Another advantage of the invention is to provide a flip-up aiming sight, wherein an additional iron sight is provided to enable an operator to aim at the iron sight of the firearm through the sight channel when the reflecting lens is unfolded.

Another advantage of the invention is to provide a flip-up aiming sight, which can be incorporated with different existing firearms, or can be built-in with the existing firearms.

Another advantage of the invention is to provide a flip-up aiming sight, which does not require altering the original mounting structure of the firearm, so as to minimize the manufacturing cost of the flip-up aiming sight incorporating with the firearm.

Another object of the present invention is to provide a flip-up aiming sight, wherein no expensive or complicated structure is required to employ in the present invention in order to achieve the above mentioned objects. Therefore, the present invention successfully provides an economic and efficient solution for providing low-profiled and flip-up aiming sight for the firearm.

Additional advantages and features of the invention will become apparent from the description which follows, and may be realized by means of the instrumentalities and combinations particular point out in the appended claims.

According to the present invention, the foregoing and other objects and advantages are attained by a flip-up aiming sight for a firearm, comprising:

a mounting base adapted for attaching onto the firearm, wherein the mounting base has a platform defined at a top side;

a sight module which comprises an illuminator embedded at the mounting base; and a flip up lens module which comprises a lens frame pivotally coupled at a front side of the mounting base and a reflecting lens encirclingly mounted at the lens frame, wherein the flip up lens module is arranged to pivotally fold between a folded position and an unfolded position, wherein at the folded position, the lens frame is rearwardly and downwardly folded flat on the platform of the mounting base, and at the unfolded position, the lens frame is frontwardly and upwardly moved from the platform, such that the illuminator generates an aiming point on the reflecting lens.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It is appreciated that the terms "upper", "lower", "front", "rear", "left", "right", vertical", "horizontal", "top", "bottom", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

Figure 1:
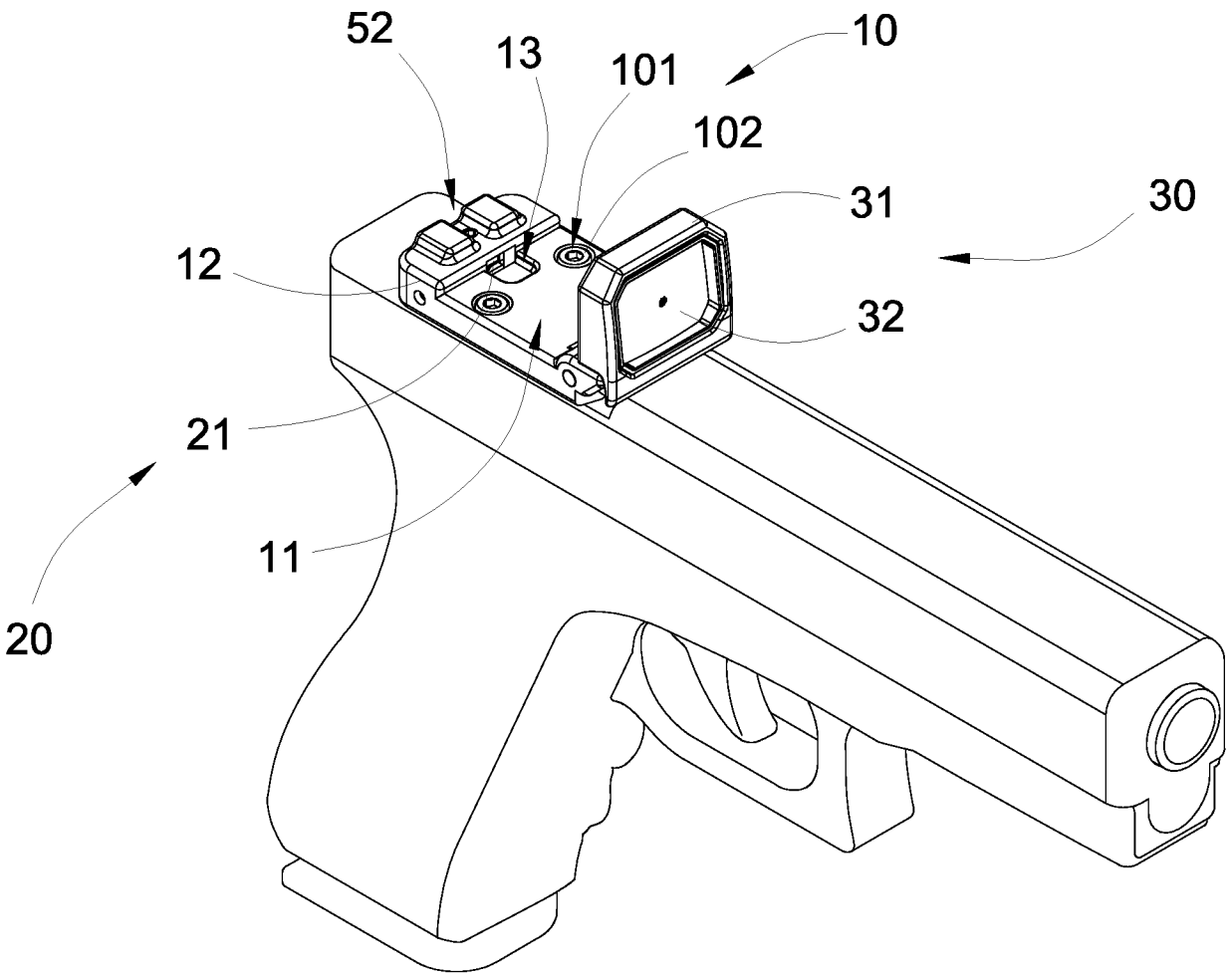
FIG. 1 is a perspective view of a flip-up aiming sight mounted on a firearm according to a preferred embodiment of the present invention.
Figure 2:
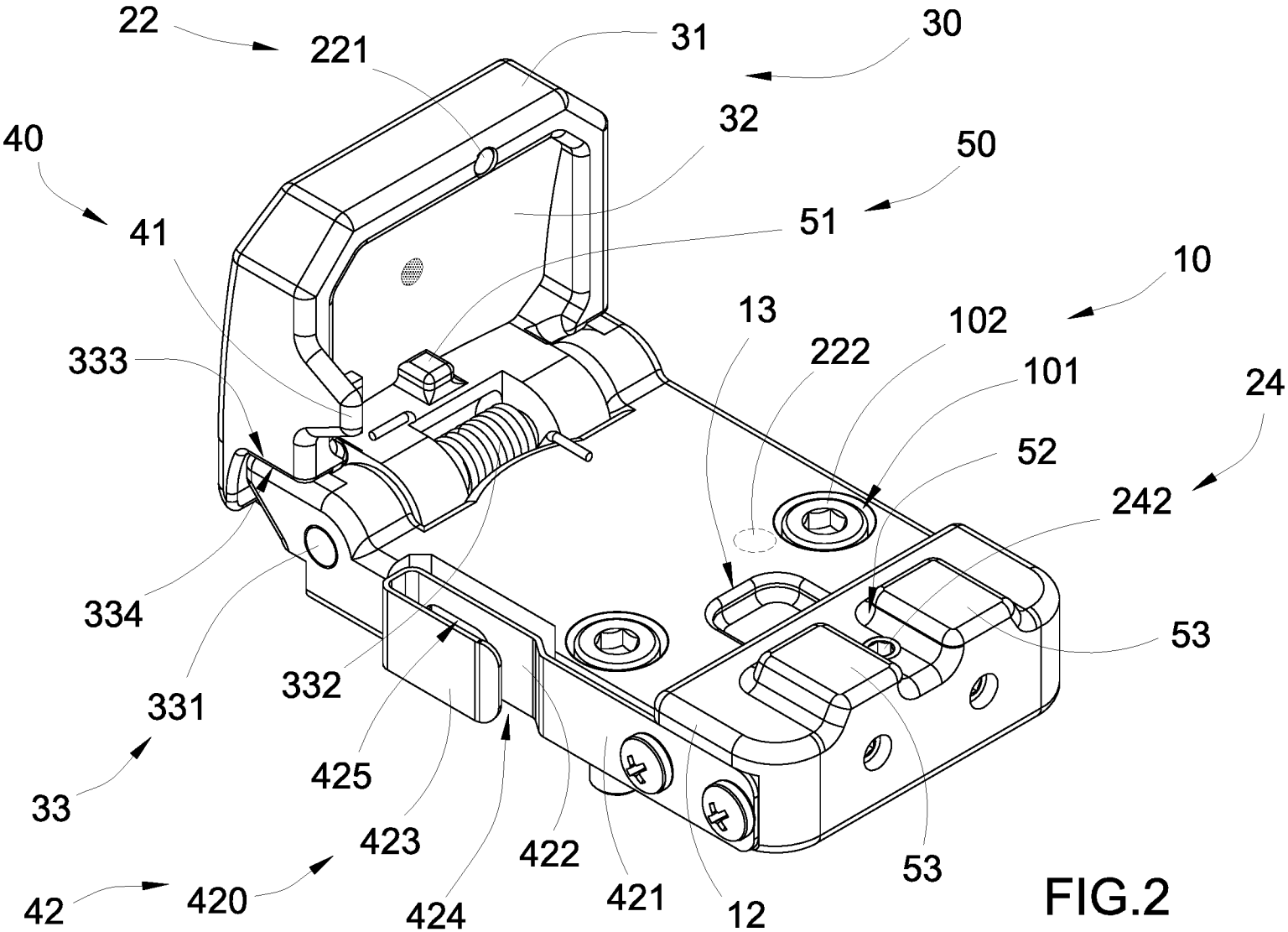
FIG. 2 is a perspective view of the flip-up aiming sight at an unfolded position according to a preferred embodiment of the present invention.
Figure 3:
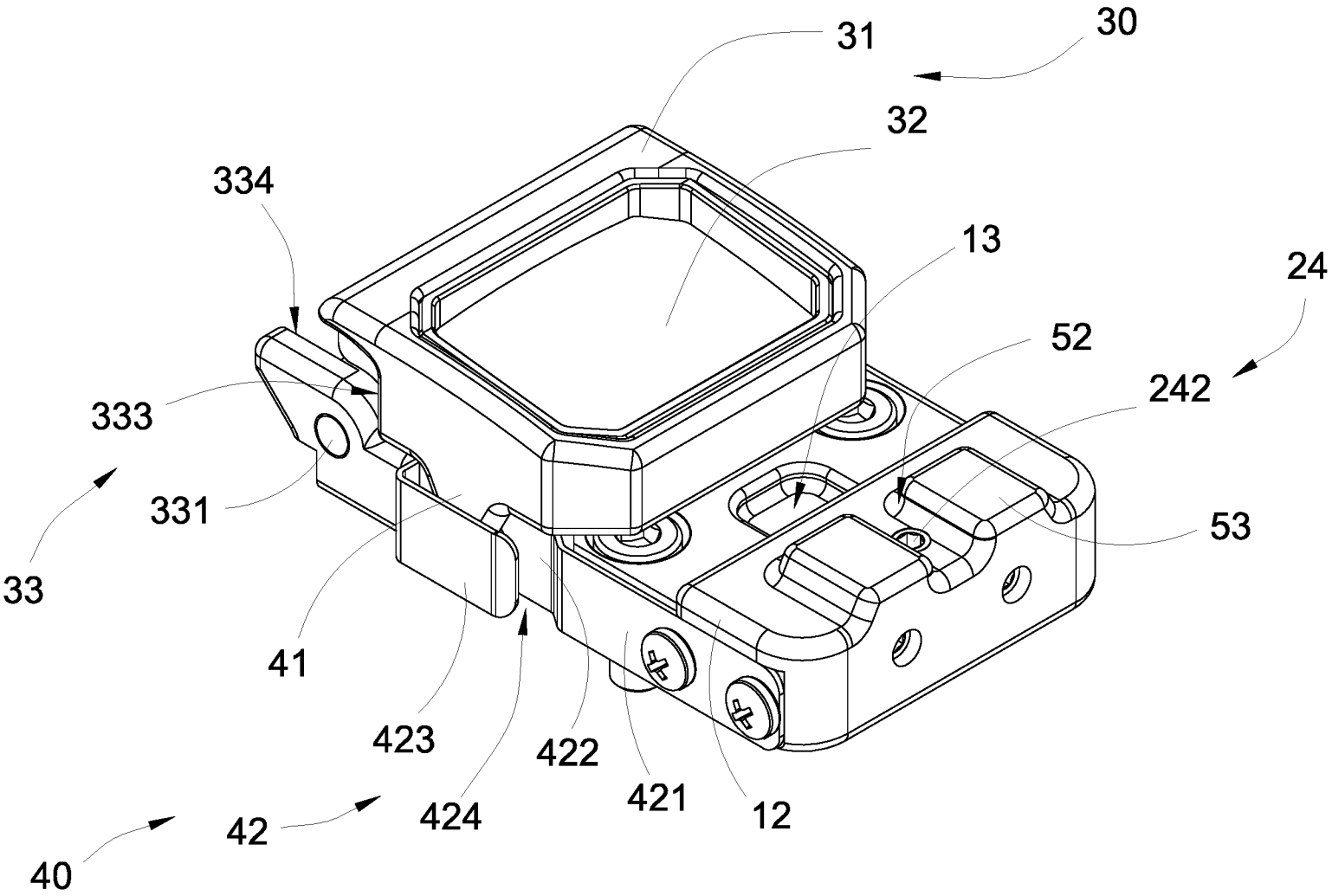
FIG. 3 is a perspective view of the flip-up aiming sight at a folded position according to a preferred embodiment of the present invention.

Referring to FIGS. 1 to 3 of the drawings, a flip-up aiming sight according to a preferred embodiment of the present invention, wherein the flip-up aiming sight is arranged to be mounted on a firearm, especially for handgun or pistol, for enabling an operator to aim a target so as to accurately locate the target and perform the shooting. As shown in FIGS. 2 and 3, the a flip-up aiming sight comprises a mounting base 10, a sight module 20, and a flip up lens module 30.

The mounting base 10 adapted for attaching onto the firearm, wherein the mounting base has a platform 11 defined at a top side. Accordingly, the mounting base 10 has two through mounting slots 101 downwardly extended from the platform 11 of the mounting base 10 to a bottom side thereof, wherein two fasteners 102, such as two screws, are extended from the platform 11 to the bottom side through the mounting slots 101 to detachably fasten at two firearm slots of the firearm, so as to detachably couple the mounting base 10 on the firearm. Preferably, the firearm slots are formed at a top side of the firearm, such that the mounting base 10 is attached to the top side of the firearm via the fasteners 102. It is appreciated that the mounting base 10 can be mounted to the firearm via an existing mounting structure such as "M Lock", "Weaver" mounting structure, a "Picatinny" mounting structure, or "KeyMod" mounting structure.

The platform 11 of the mounting base 10 is a flat surface to support the sight module 20. Accordingly, the mounting base 10 further has a raised portion 12 upwardly extended from a rear side of the platform 11 and a receiving cavity 13 indented on the platform 11 and extended to a front wall of the raised portion 12.

The sight module 20 comprises an illuminator 21 embedded at the mounting base 10. In particular, the illuminator 21 is received at the receiving cavity 13 and is embedded in the raised portion 12 of the mounting base 10, such that the illuminator 21 is protected within the mounting base 10.

The flip up lens module 30 comprises a lens frame 31 pivotally coupled at a front side of the mounting base 10 and a reflecting lens 32 encirclingly mounted within the lens frame 31. Accordingly, the flip up lens module 30 is arranged to pivotally fold between a folded position and an unfolded position, wherein at the folded position, the lens frame 31 is rearwardly and downwardly folded flat on the platform 11 of the mounting base 10 as shown in FIG. 3, and at the unfolded position, the lens frame 31 is frontwardly and upwardly moved from the platform 11, as shown in FIG. 2, such that the illuminator 21 generates an aiming point on the reflecting lens 32. Preferably, the lens frame 31 is pivotally moved in an upright manner from the platform 11 at the unfolded position. In addition, the reflecting lens 32 is a transparent lens that shows the aiming point thereon. Preferably, the reflecting lens 32 is inclinedly supported within the lens frame 31 when the flip up lens module 30 is moved at the unfolded position.

Figure 5:
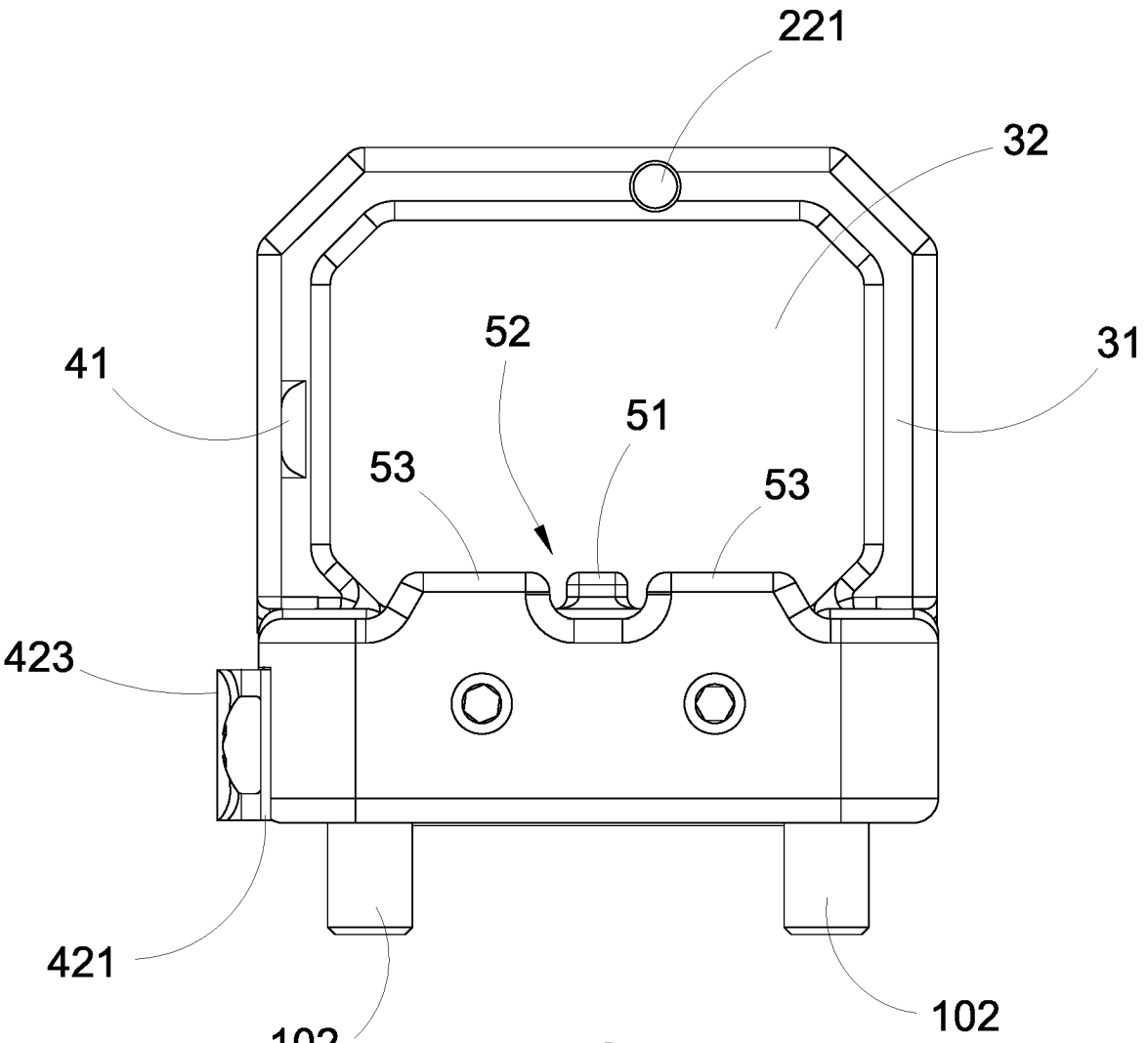
FIG. 5 is a rear view of the flip-up aiming sight at the unfolded position according to a preferred embodiment of the present invention.

As shown in FIGS. 2 and 5, the lens frame 31 preferably has a rectangular shape and defines a top frame wall, a bottom frame wall, and two side frame walls to form a lens cavity therewithin, wherein the reflecting lens 32 is supported within the lens cavity. It is appreciated that the shape of the lens frame 31 can be modified to have different shapes such as polygonal shape or oval shape. When the lens frame 31 is folded flat on the platform 11 of the mounting base 10, the reflecting lens 32 is laid on the platform 11. It is worth mentioning that the mounting base 10 does not contain any cavity to receive the flip up lens module 30 at the folded position, since the flip up lens module 30 is only folded flat on the platform 11 of the mounting base 10, so as to minimize the size, especially the thickness, of the mounting base 10. Therefore, the flip-up aiming sight of the present invention is a low-profile aiming sight for the firearm to ensure the aiming point on the reflecting lens 32 close to a barrel axis of the firearm.

According to the preferred embodiment, the lens frame 31 is pivotally coupled at the mounting base 10 via a folding joint 33. The folding joint 33 comprises a pivot shaft 331 coupled between the lens frame 31 and the mounting base 10. In particular, the bottom frame wall of the lens frame 31 is pivotally coupled at the front portion of the mounting base 10 via the pivot shaft 331 to enable the lens frame 31 to be pivotally moved with respect to the mounting base 10.

The folding joint 33 further comprises a resilient element 332 coupled at the pivot shaft 331 for applying a resilient force to pivotally move the flip up lens module 30 from the folded position to the unfolded position. In particular, the resilient element 332 is a coil spring coaxially coupled at the pivot shaft 331, wherein the resilient element 332 has two ends biasing against the bottom frame wall of the lens frame 31 and the front portion of the mounting base 10 at the platform 11 thereof respectively, such that the resilient force, i.e. the spring force, will push the lens frame 31 from the folded position to the unfolded position.

Figure 4:
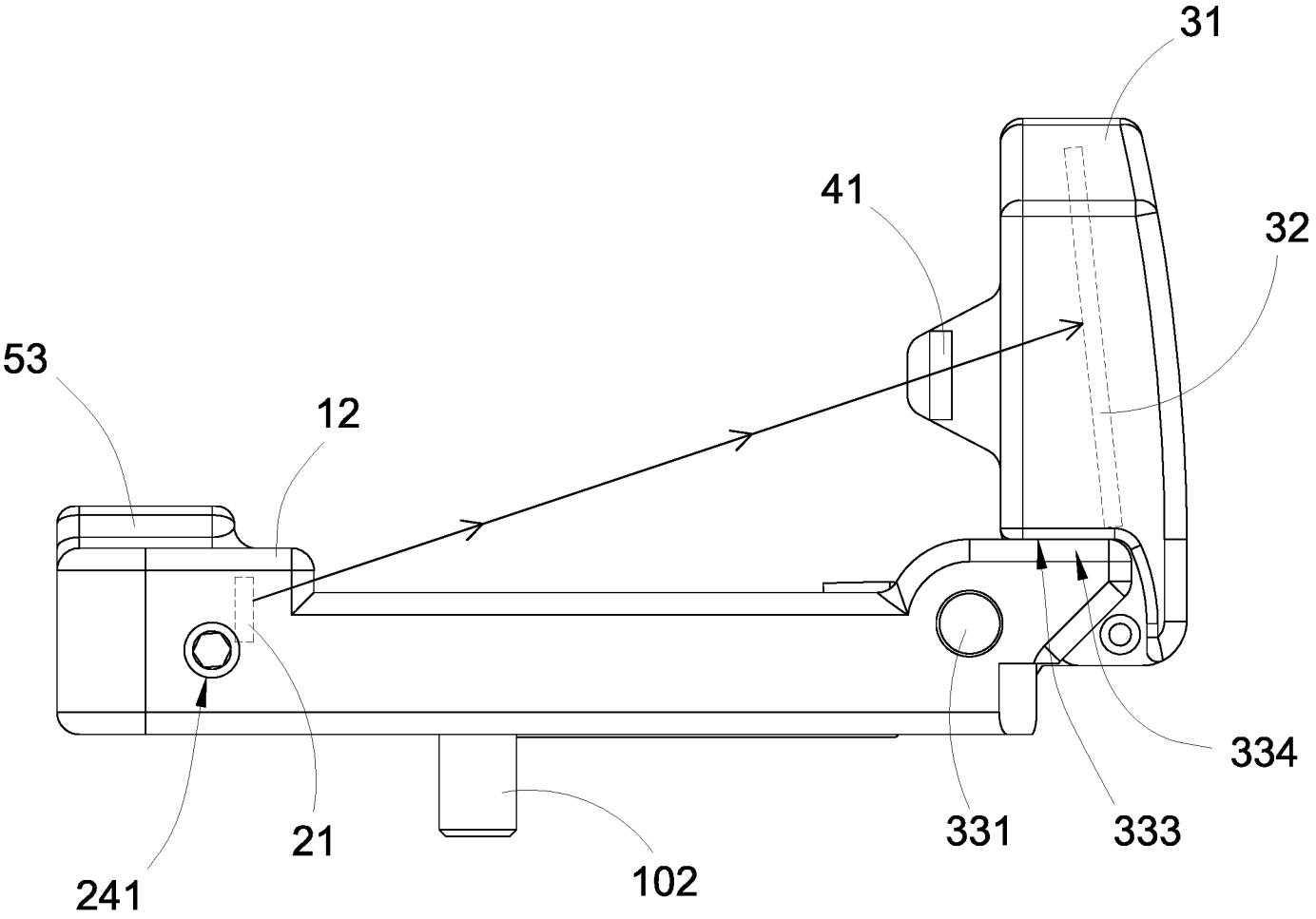
FIG. 4 is a side view of the flip-up aiming sight at the unfolded position according to a preferred embodiment of the present invention.

As shown in FIGS. 2 and 4, the folding joint 33 further has a first retention surface 333 formed at a bottom portion of the lens frame 31 and a second retention surface 334 formed at the mounting base 10. The first retention surface 333 is formed at a bottom side of the bottom frame wall of the lens frame 31 and the second retention surface 334 is formed at the top side of the mounting base 10, such that when the first retention surface 333 is biased against the second retention surface 334, the flip up lens module 30 is retained at the unfolded position. In one embodiment, the first retention surface 333 is vertically oriented when the lens frame 31 is moved at the unfolded position and is horizontally oriented when the lens frame 31 is moved at the folded position. The second retention surface 334 is horizontally oriented when the mounting base 10 is attached onto the firearm.

In other words, when the lens frame 31 is upwardly and pivotally moved from the platform 11, the pivotal movement of the lens frame 31 is stopped when the first and second retention surfaces 333, 334 are biased against each other to prevent the further pivotal movement of the lens frame 31. Therefore, the first and second retention surfaces 333, 334 will prevent the lens frame 31 being over-folded at the unfolded position.

Figure 6:
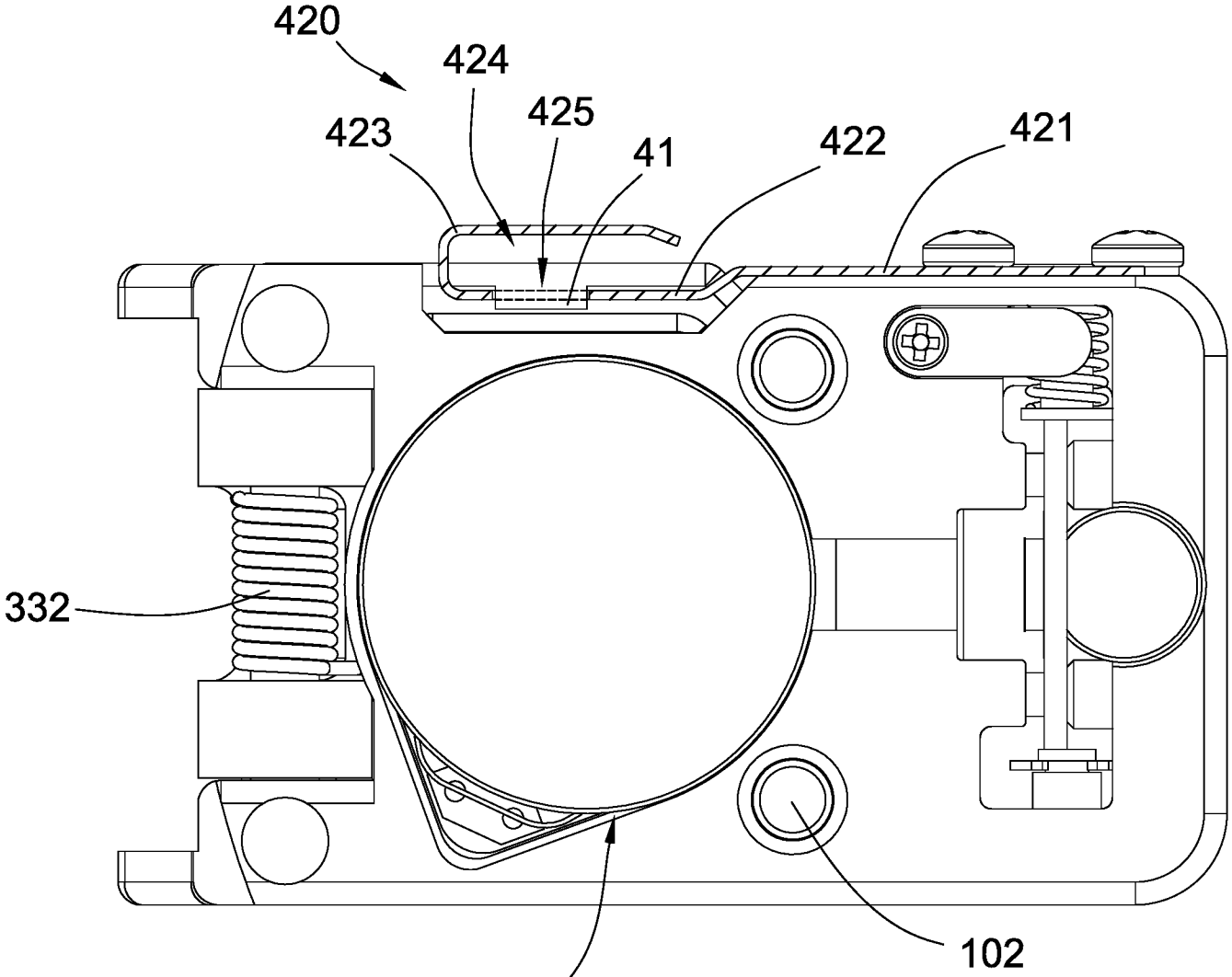
FIG. 6 is a bottom view of the flip-up aiming sight at an unfolded position according to a preferred embodiment of the present invention.

As shown in FIGS. 2 and 6, the flip-up aiming sight further comprises a locking unit 40 for locking the flip up lens module 30 at the folded position. The locking unit 40 comprises a locking latch 41 integrally extended from one of the side frame walls of the lens frame 31 and a locking actuator 42 extended from a sidewall of the mounting base 10. The locking latch 41, having a latch end, is rearwardly extended from the side frame wall of the lens frame 31, such that when the lens frame 31 is pivotally folded on the platform 11, the locking latch 41 is driven to move towards the sidewall of the mounting base 10 to engage with the locking actuator 42. In other words, the locking actuator 42 is engaged with the locking latch 41 to lock up the flip up lens module 30 at the folded position and is actuated to disengage with the locking latch 41 to enable the flip up lens module 30 to pivotally move to the unfolded position.

The locking actuator 42 is made of flexible panel to have a predetermined flexibility. The locking actuator 42 has a coupling wall 421 coupled at the side frame wall of the mounting base 10 and a U-shaped control portion 420 integrally extended from the coupling wall 421. The U-shaped control portion 420 has an inner locking wall 422 integrally extended from the coupling wall 421, an outer actuating wall 423 spaced apart from the inner locking wall 422 to define a locking cavity 424 between the inner locking wall 422 and the outer actuating wall 423, and a locking slot 425 formed at the inner locking wall 422. When the lens frame 31 is pivotally folded on the platform 11 at a position that the locking latch 41 is extended into the locking cavity 424 to engage the latch end of the locking latch 42 with the locking slot 425, the flip up lens module 30 is locked at the folded position. When the outer actuating wall 423 is pushed toward the inner locking wall 422, the inner locking wall 422 is moved to disengage the latch end of the locking latch 41 with the locking slot 425, such that the flip up lens module 30 is unlocked to pivotally move to the unfolded position. Therefore, the locking actuator 42 not only provides a locking structure, i.e. the locking slot 425, to engage with the locking latch 41 for locking up the lens frame 31 at the folded position but also provides a releasing structure, i.e. the outer actuating wall 423, to disengage with the locking latch 41 for unlocking the lens frame 31 at the folded position. It is worth mentioning that when the lens frame 31 is unlocked at the folded position, the resilient element 332 will push the lens frame 31 from the folded position to the unfolded position, such that the flip up lens module 30 will be automatically moved from the folded position to the unfolded position.

The mounting base 10 further has an indented slot 14 indented from the sidewall of the mounting base 10 that the U-shaped control portion 420 of the locking actuator 42 is received at the indented slot 14. Therefore, the width of the mounting base 10, i.e. a distance between the sidewalls thereof, can be reduced to incorporate with the U-shaped control portion 420 of the locking actuator 42. In addition, the indented slot 14 will create enough actuating space to allow the inward movement of the inner locking wall 422 by the outer actuating wall 421 to disengage the latch end of the locking latch 41 with the locking slot 425 at the inner locking wall 422. It is worth mentioning that once the inward pushing force is released from the outer actuating wall 421, the flexibility of the locking actuator 42 will push the inner locking wall 422 back to its original position.

In one embodiment, the locking unit 40 is provided at a left side of the flip-up aiming sight for a right-hand user. In other words, the locking latch 41 is extended from the left side frame wall of the lens frame 31 and the locking actuator 42 extended from the left sidewall of the mounting base 10, such that the user is able to hold the firearm by the right hand and to actuate the locking unit 40 by the left hand. It is appreciated that the locking unit 40 can be provided at a right side of the flip-up aiming sight for a left-hand user.

According to the preferred embodiment, the sight module 20 further comprises a sensor switch 22 for automatically activating the illuminator 21 when the flip up lens module 30 is moved at the unfolded position and for automatically deactivating the illuminator 21 when the flip up lens module 30 is moved at the folded position.

In one embodiment, the sensor switch 22 is a magnetic switch which comprises a first magnetic element 221 provided at the lens frame 31 and a second magnetic element 222 embedded under the platform 11 to operatively link to the illuminator 21. Accordingly, the first magnetic element 221 is provided at a rear side of the top frame wall of the lens frame 31, and the second magnetic element 222 is embedded under the platform 11, i.e. an interior of the mounting base 10, at a position corresponding to first magnetic element 221 being folded on the platform 11. At the folded position, the first magnetic element 221 is magnetically induced with the second magnetic element 222 to automatically switch off the illuminator 21 and at the unfolded position, the first magnetic element 221 is moved away from the second magnetic element 22 so as to automatically switch on the illuminator 21. It is appreciated that the sensor switch 22 can be a touch switch provided at the lens frame 31 or at the platform 11, such that when the lens frame 31 is folded flat on the platform 11, the touch switch is contacted with the platform 11 or the lens frame 31 to automatically switch off the illuminator 21 and when the lens frame 31 is moved away from the platform 11, the touch switch is non-contacted to automatically switch on the illuminator 21. Other sensor switches can be incorporated in the present invention to automatically switch on-and-off the illuminator 21. However, the magnetic switch provides a reliable operation to control the illuminator 21 in an on-and-off manner.

As shown in FIG. 6, the sight module 20 further comprises a battery compartment 23 indentedly formed at the bottom side of the mounting base 10 for receiving a battery in the battery compartment 23 to electrically connect to the illuminator 21. Accordingly, when the mounting base 10 is attached onto the firearm, the bottom side of the mounting base 10 is coupled on the top side of the firearm, such that the battery compartment 23 is enclosed by the top side of the firearm. Therefore, no bottom cover is required for coupling at the bottom side of the mounting base 10 to enclose the battery compartment 23. In addition, once the bottom side of the mounting base 10 is coupled on the firearm, the battery is secured in the battery compartment 23 to prevent any dislocation of the battery.

The sight module 20 further comprises a positioning adjustor 24 provided at the mounting base 10 to selectively adjust an orientation of the illuminator 21. The positioning adjustor 24 has a horizontal adjusting slot 241 provided at the sidewall of the mounting base 10 to selectively adjust a horizontal position of the illuminator 21 and a vertical adjusting slot 242 provided at the top side of the mounting base 10 to selectively adjust a vertical position of the illuminator 21. Preferably, the vertical adjusting slot 242 is provided at the raised portion 12 of the mounting base 10. Accordingly, by inserting an adjusting tool into the horizontal adjusting slot 241, the illuminator 21 can be selectively moved to the right or left direction. For example, when the adjusting tool is rotated at the clockwise direction, the illuminator 21 is driven to horizontally move at the right direction and when the adjusting tool is rotated at the counter clockwise direction, the illuminator 21 is driven to horizontally move at the left direction. By inserting the adjusting tool into the vertical adjusting slot 242, the illuminator 21 can be selectively moved to the up-and-down direction. For example, when the adjusting tool is rotated at the clockwise direction, the illuminator 21 is driven to vertically move at the upward direction and when the adjusting tool is rotated at the counter clockwise direction, the illuminator 21 is driven to vertically move at the downward direction. Therefore, the user is able to selectively adjust the position of the illuminator 21 to ensure the aiming point to be projected at a center of the reflecting lens 32.

In case of the malfunction of the sight module 20, the flip-up aiming sight further comprises a backup sight unit 50. The backup sight unit 50 comprises a front iron sight 51 upwardly extended from a bottom rim of the lens frame 31 and a rear sight channel 52 indented on the platform 11 to align with the front iron sight 51 when the flip up lens module 30 is retained at the unfolded position. Accordingly, the front iron sight 51 is integrally and upwardly extended from the bottom frame wall of the lens frame 31, wherein the front iron sight 51 has a predetermined height to define a top end when the lens frame 31 is moved at the unfolded position. In order to form the rear sight channel 52, the backup sight unit 50 comprises two sight protrusions 53 spacedly and upwardly extended from the raised portion 12 of the mounting base 10, wherein the rear sight channel 52 is formed between the sight protrusions 53. It is worth mentioning that the top end of the front iron sight 51 is aligned at the same horizontal level of a top side of each of the sight protrusions 53 as shown in FIGS. 2 and 5. Preferably, the vertical adjusting slot 242 is provided at the raised portion 12 of the mounting base 10 between the sight protrusions 53.

According to the preferred embodiment, the mounting operation of the flip-up aiming sight on the firearm is simple by fastening the fasteners 102 to the top side of the firearm. Once the flip-up aiming sight on the firearm, the user is able to operate the flip-up aiming sight via a single actuating movement by pressing the outer actuating wall 421 to unlock the flip up lens module 30. Therefore, the flip up lens module 30 is automatically moved from the folded position to the unfold position via the resilient element 332 and, at the same time, the illuminator 31 is automatically switched on via the sensor switch 22 to generate the aiming point at the reflecting lens 32. Once the lens frame 31 is pivotally moved to fold flat on the platform 11, the flip up lens module 30 is automatically locked at the folded position via the locking unit 40 and, at the same time, the illuminator 31 is automatically switched off via the sensor switch 22.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flip-up aiming sight for a firearm, comprising:

a mounting base adapted for attaching onto the firearm, wherein said mounting base has a platform defined at a top side;

a sight module which comprises an illuminator embedded at said mounting base;

a flip up lens module which comprises a lens frame pivotally coupled at said mounting base and a reflecting lens mounted within said lens frame, wherein said flip up lens module is arranged to pivotally folded between a folded position and an unfolded position, wherein at said folded position, said lens frame is rearwardly and downwardly folded on said platform of said mounting base, and at said unfolded position, said lens frame is frontwardly and upwardly moved from said platform, such that said illuminator generates an aiming point on said reflecting lens; and a locking unit for locking said flip up lens module at said folded position, wherein said locking unit comprises a locking latch extended from said lens frame and a locking actuator extended from said mounting base in such a manner that said actuator is engaged with said locking latch to lock up said flip up lens module at said folded position and is actuated to disengage with said locking latch to enable said flip up lens module to pivotally move to said unfolded position, wherein said locking actuator has a coupling wall and a control portion defining a locking wall integrally extended from said coupling wall, an actuating wall spaced apart from said locking wall to define a locking cavity between said locking wall and said actuating wall, and a locking slot formed at said locking wall, wherein when said locking latch is extended into said locking cavity to engage with said locking slot, said flip up lens module is locked at said folded position, and when said actuating wall is pushed to move to disengage said locking latch with said locking slot, such that said flip up lens module is unlocked to pivotally move to said unfolded position.

2. The flip-up aiming sight, as recited in claim 1, wherein said lens frame is pivotally coupled at a front side of said mounting base, wherein at said folded position, said lens frame is rearwardly and downwardly folded flat on said platform of said mounting base, wherein said locking latch is integrally extended from a side frame wall of said lens frame and said locking actuator is extended from a sidewall of said mounting base and arranged, wherein said locking actuator is made of flexible panel and said coupling wall is coupled at said side frame wall of said mounting base and said control portion is a U-shaped control portion defining said locking wall which is an inner locking wall integrally extended from said coupling wall, wherein said actuating wall is an outer actuating wall spaced apart from said inner locking wall to define said locking cavity between said inner locking wall and said outer actuating wall, wherein said locking slot is formed at said inner locking wall, wherein when said outer actuating wall is pushed toward said inner locking wall, said inner locking wall is moved to disengage said locking latch with said locking slot, such that said flip up lens module is unlocked to pivotally move to said unfolded position.

3. The flip-up aiming sight, as recited in claim 2, wherein said mounting base further has an indented slot indented from said sidewall of said mounting base that said U-shaped control portion of said locking actuator is received at said indented slot.

4. A flip-up aiming sight for a firearm, comprising:

a mounting base adapted for attaching onto the firearm, wherein said mounting base has a platform defined at a top side, wherein said mounting base further has a receiving cavity indented on said platform;

a sight module which comprises an illuminator embedded at said mounting base and received at said receiving cavity, wherein said sight module further comprises a sensor switch for automatically activating said illuminator and a battery compartment indentedly formed at a bottom side of said mounting base for receiving a battery in said battery compartment to electrically connect to said illuminator, wherein said sensor switch comprises a first magnetic element and a second magnetic element;

a flip up lens module which comprises a lens frame pivotally coupled at a front side of said mounting base and a reflecting lens encirclingly mounted within said lens frame, wherein said flip up lens module is arranged to pivotally fold between a folded position and an unfolded position, wherein at said folded position, said lens frame is rearwardly and downwardly folded flat on said platform of said mounting base, and at said unfolded position, said lens frame is frontwardly and upwardly moved from said platform, such that said illuminator generates an aiming point on said reflecting lens, wherein said first magnetic element is provided at said lens frame and said second magnetic element is embedded under said platform to operatively link to said illuminator, such that at said folded position, said first magnetic element is magnetically induced with said second magnetic element to automatically switch off said illuminator and at said unfolded position, said first magnetic element is moved away from said second magnetic element so as to automatically switch on said illuminator; and a locking unit for locking said flip up lens module at said folded position, wherein said locking unit comprises a locking latch integrally extended from a side frame wall of said lens frame and a locking actuator extended from a sidewall of said mounting base and arranged in such a manner that said locking actuator is engaged with said locking latch to lock up said flip up lens module at said folded position and is actuated to disengage with said locking latch to enable said flip up lens module to pivotally move to said unfolded position, wherein said locking actuator, which is made of flexible panel, has a coupling wall coupled at said side frame wall of said mounting base and a U-shaped control portion defining an inner locking wall integrally extended from said coupling wall, an outer actuating wall spaced apart from said inner locking wall to define a locking cavity between said inner locking wall and said outer actuating wall, and a locking slot formed at said inner locking wall, wherein when said locking latch is extended into said locking cavity to engage with said locking slot, said flip up lens module is locked at said folded position, and when said outer actuating wall is pushed toward said inner locking wall, said inner locking wall is moved to disengage said locking latch with said locking slot, such that said flip up lens module is unlocked to pivotally move to said unfolded position.

5. The flip-up aiming sight, as recited in claim 4, wherein said mounting base further has an indented slot indented from said sidewall of said mounting base that said U-shaped control portion of said locking actuator is received at said indented slot.

6. The flip-up aiming sight, as recited in claim 5, wherein said lens frame is pivotally coupled at said mounting base via a folding joint which comprises a pivot shaft coupled between said lens frame and said mounting base to enable said lens frame to be pivotally moved with respect to said mounting base, and a resilient element coupled at said pivot shaft for applying a resilient force to pivotally move said flip up lens module from said folded position to said unfolded position.

7. The flip-up aiming sight, as recited in claim 6, wherein said folding joint further has a first retention surface formed at a bottom portion of said lens frame and a second retention surface formed at said mounting base, such that when said first retention surface is biased against said second retention surface, said flip up lens module is retained at said unfolded position.

8. The flip-up aiming sight, as recited in claim 7, wherein said sight module further comprises a positioning adjustor provided at said mounting base to selectively adjust an orientation of said illuminator, wherein said positioning adjustor has a horizontal adjusting slot provided at a sidewall of said mounting base to selectively adjust a horizontal position of said illuminator and a vertical adjusting slot provided at said top side of said mounting base to selectively adjust a vertical position of said illuminator to ensure said aiming point to be projected at a center of said reflecting lens.

9. The flip-up aiming sight, as recited in claim 8, further comprising a front iron sight upwardly extended from a bottom rim of said lens frame and a rear sight channel indented on said platform to align with said front iron sight when said flip up lens module is retained at said unfolded position.

* * * * *